US006701863B2

(12) United States Patent
Kalhok et al.

(10) Patent No.: US 6,701,863 B2
(45) Date of Patent: Mar. 9, 2004

(54) WATERCRAFT WITH COLLAPSIBLE PRIVACY COMPARTMENT

(75) Inventors: David Kalhok, Marion, IL (US); Martin Aubé, St-Bruno-de-Montarville (CA)

(73) Assignee: Bombardier Recreational Products Inc., Montreal (CA)

( * ) Notice: Subject to any disclaimer, the term of this patent is extended or adjusted under 35 U.S.C. 154(b) by 0 days.

(21) Appl. No.: 10/207,003

(22) Filed: Jul. 30, 2002

(65) Prior Publication Data

US 2002/0195041 A1 Dec. 26, 2002

Related U.S. Application Data

(63) Continuation-in-part of application No. 09/635,262, filed on Aug. 9, 2000.

(60) Provisional application No. 60/168,676, filed on Dec. 3, 1999, and provisional application No. 60/308,099, filed on Jul. 30, 2001.

(30) Foreign Application Priority Data

Aug. 9, 1999 (CA) ..... 2279804

(51) Int. Cl.[7] ..... B63B 17/00

(52) U.S. Cl. ..... 114/361; 114/343

(58) Field of Search ..... 114/343, 361, 114/364; 4/449, 460, 312

(56) References Cited

U.S. PATENT DOCUMENTS

| | | | | |
|---|---|---|---|---|
| 2,713,841 | A | | 7/1955 | Forbes |
| 2,766,714 | A | | 10/1956 | Hammers |
| 3,290,706 | A | | 12/1966 | Hale |
| 3,428,976 | A | | 2/1969 | Robinson |
| 3,811,143 | A | | 5/1974 | Page |
| 3,823,431 | A | | 7/1974 | Miller |
| 3,949,700 | A | | 4/1976 | Baroody |
| 4,033,280 | A | | 7/1977 | Wood et al. |
| 4,040,693 | A | | 8/1977 | Peterson et al. |
| 4,742,795 | A | | 5/1988 | DePrey et al. |
| 4,883,016 | A | | 11/1989 | Larson |
| 4,957,056 | A | | 9/1990 | Martin |
| 5,029,348 | A | | 7/1991 | Boren |
| 5,095,843 | A | | 3/1992 | Kobayashi |
| 5,123,372 | A | | 6/1992 | Kobahashi et al. |
| 5,136,963 | A | | 8/1992 | Zuzik |
| 5,143,013 | A | | 9/1992 | Huebner |
| 5,150,663 | A | | 9/1992 | Kobayashi |
| 5,237,950 | A | | 8/1993 | Abe et al. |
| 5,331,917 | A | | 7/1994 | Magers |
| 5,349,919 | A | | 9/1994 | Douglass |
| 5,355,826 | A | | 10/1994 | Hattori et al. |
| 5,366,028 | A | | 11/1994 | Kobayashi |
| 5,379,466 | A | * | 1/1995 | Davies ..... 4/449 |
| 5,416,670 | A | | 5/1995 | Authier |
| 5,490,474 | A | | 2/1996 | Ikeda |
| 5,497,724 | A | * | 3/1996 | Brown et al. ..... 114/343 |
| 5,537,948 | A | | 7/1996 | Kobayashi |
| 5,566,637 | A | | 10/1996 | Benza |
| 5,572,944 | A | | 11/1996 | Slikkers et al. |
| 5,915,329 | A | | 6/1999 | Watkins et al. |
| 6,062,922 | A | | 5/2000 | Nanami |
| 6,071,156 | A | | 6/2000 | Platzer et al. |
| 6,168,481 | B1 | | 1/2001 | Mardikian |
| 6,236,826 | B1 | | 5/2001 | Kurz et al. |
| 6,302,053 | B1 | * | 10/2001 | Tomczak et al. ..... 114/363 |

* cited by examiner

*Primary Examiner*—Sherman Basinger
(74) *Attorney, Agent, or Firm*—BRP Legal Services

(57) ABSTRACT

A watercraft has a collapsible privacy compartment that accommodates an adult when the compartment is opened. The privacy compartment includes a cover that is movably connected to the deck and a flexible curtain that is connected to the cover. When the privacy compartment is closed, the cover at least partially conceals the privacy compartment within the deck. When the privacy compartment is opened, the cover at least partially supports the deployed privacy compartment. The cover may simultaneously function as an engine cover.

22 Claims, 8 Drawing Sheets

WATERCRAFT WITH COLLAPSIBLE PRIVACY COMPARTMENT

CROSS-REFERENCE

This application is a continuation-in-part of U.S. Non-provisional patent application Ser. No. 09/635,262, filed on Aug. 9, 2000, now pending, which is incorporated herein by reference. This application also claims the benefit of U.S. Provisional Patent Application No. 60/168,676, filed Dec. 3, 1999, and Canadian Patent Application No. 2,279,804, filed Aug. 9, 1999, both of which are incorporated herein by reference. The parent application relies on these two applications for priority. In addition, this application relies for priority on U.S. Provisional Patent Application Ser. No. 60/308,099, filed on Jul. 30, 2001, the contents of which are incorporated herein by reference.

FIELD OF THE INVENTION

This invention relates to watercraft and more particularly to a collapsible privacy compartment located on the deck of a watercraft.

BACKGROUND OF THE INVENTION

Various types of watercraft exist, each being suited for different types of activities. Watercraft range from the smallest type, which include personal watercraft and row boats, to the largest type including cruise ships and yachts. Within this wide range of boats, there is a specific class that is large enough to accommodate multiple passengers but is too small to include an enclosed cabin or compartment capable of accommodating a fully grown adult. This class of watercraft encompasses boats more commonly referred to as sport boats and pontoon boats, for example.

For ease of the discussion that follows, watercraft without an enclosed cabin or compartment will be referred to as "open deck" boats. As the name suggests, open deck boats share a common design feature: the entire deck space of open deck boats is completely visible from the exterior of the watercraft. With the exception of storage lockers and cabinets that may be incorporated into the deck design in locations under seats and in the floor of the deck, open deck boats lack a privacy compartment.

Conventional wisdom suggests that open deck boats simply have no room to accommodate a privacy compartment. If a privacy compartment is desired, the owner may purchase a tent-like enclosure that could be erected on the deck of the boat when needed. Alternatively, the owner may purchase and install a convertible top, bimini, or other canopy system to provide some privacy to the boat's passengers. However, such canopy systems also enclose at least a portion of the deck space and stalls do not enclose a privacy compartment.

U.S. Pat. No. 5,331,917 is illustrative of at least one privacy enclosure designed for use on a pontoon boat. As shown, a ledge 38, which may lie in a horizontal arrangement or may be pivoted upwardly to provide access to the door 36, is disposed at one end of the pontoon boat 10. A curtain rod 56 is pivotally positioned beneath the ledge 38. When deployed, a curtain 64 extends downwardly from the curtain rod 56. Due to this arrangement, a person utilizes the head 54 in a seated position, and can expect to have his or her head exposed above the top of the curtain 64. Accordingly, while the curtain 64 does afford at least minimal privacy, a need still exists for a greater amount of privacy, such as provided by a privacy compartment, on boats such as deck boats. U.S. Pat. No. 4,883,016 discloses a similar privacy compartment for a pontoon boat.

U.S. Pat. No. 5,029,348 illustrates another privacy enclosure that is designed for use on a pontoon boat. A privacy compartment 3 is disposed within a housing 1 that is disposed on top of the deck of a pontoon boat. A hinged lid 7 covers the closed compartment 3 and can be pivoted upwardly to deploy the compartment 3 into an open position. A foldable frame provides support for a flexible curtain 21 that forms the sides, front, and top of the deployed compartment 3. The hinged lid 7 is connected to rear edges of curtain 21 to form part of the back side of the compartment 3. While the bulky housing 1 and compartment 3 of the '348 patent may work on the open flat deck of a pontoon boat, a need still exists for a privacy compartment that more attractively fits into the general decor of a boat and more efficiently utilizes the limited space on boats other than large, flat-decked pontoon boats.

SUMMARY OF THE INVENTION

It is, therefore, an objective of the present invention to provide a watercraft which combines the features of a small boat with some amenities normally associated with large boats.

The present invention provides a watercraft with a powered hull and a deck disposed on the hull. A collapsible privacy compartment is disposed in the deck and has a closed position and an open position that accommodates an adult therein. A cover is adapted to (1) mate with at least a portion of the deck when in the closed position, (2) conceal at least a portion of the privacy compartment when in the closed position, and (3) provide at least partial support for the privacy compartment when deployed in the open position.

The watercraft may further include an engine mounted to the powered hull to provide propulsion to the watercraft. The privacy compartment is positioned next to (i.e., beside, in front of, behind, above, etc.) the engine and the cover forms an engine cover that covers both the engine and the privacy compartment when the privacy compartment is in the closed position.

According to an alternative aspect of the present invention, the watercraft may include an engine cover having first and second independently movable pieces, the first piece being adapted to selectively cover the engine and the second piece comprising the cover such that when both pieces are closed, exterior surfaces of the first and second pieces are adjacent to and generally flush with each other.

In yet another aspect, the watercraft further includes a steering console disposed on the deck with the privacy compartment positioned forward of the steering console. Other aspects of the present invention will become apparent from the description of the invention that follows.

BRIEF DESCRIPTION OF THE DRAWINGS

The accompanying drawings, which are incorporated in and constitute a part of the specification, illustrate embodiments of the invention and, together with the general description given above and the detailed description of the embodiments given below, serve to explain the principles of the present invention. In the figures.

DETAILED DESCRIPTION OF THE PREFERRED EMBODIMENTS

Throughout the description of the several embodiments of the present invention, reference will be made to various elements, the construction of which is readily known to those skilled in the art. Accordingly, instead of providing an exhaustive description of each and every component, only a description of those elements required for an understanding of the present invention is provided.

Figure 1:
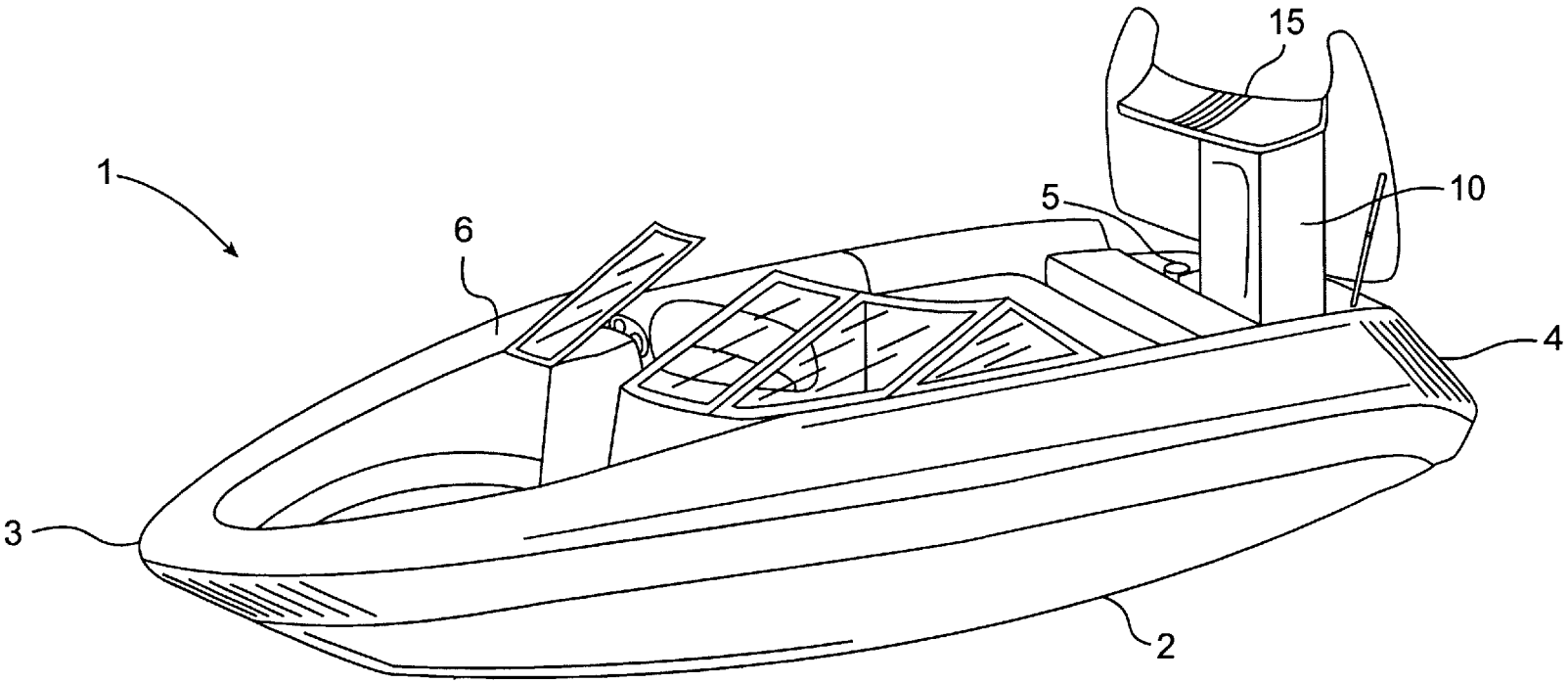
FIG. 1 is a port side perspective view of the watercraft of the present invention with the privacy compartment in the fully deployed position.

FIG. 1 is a port side perspective view of a watercraft 1 of the present invention. The watercraft 1 illustrated in FIG. 1 is a sport boat with a powered hull 2. Many of the details of the sport boat have been omitted because they are not relevant to the present invention. As those of ordinary skill in the art will appreciate after reading the description set forth below, the present invention may be employed on any watercraft, regardless of style or size.

Figure 2:
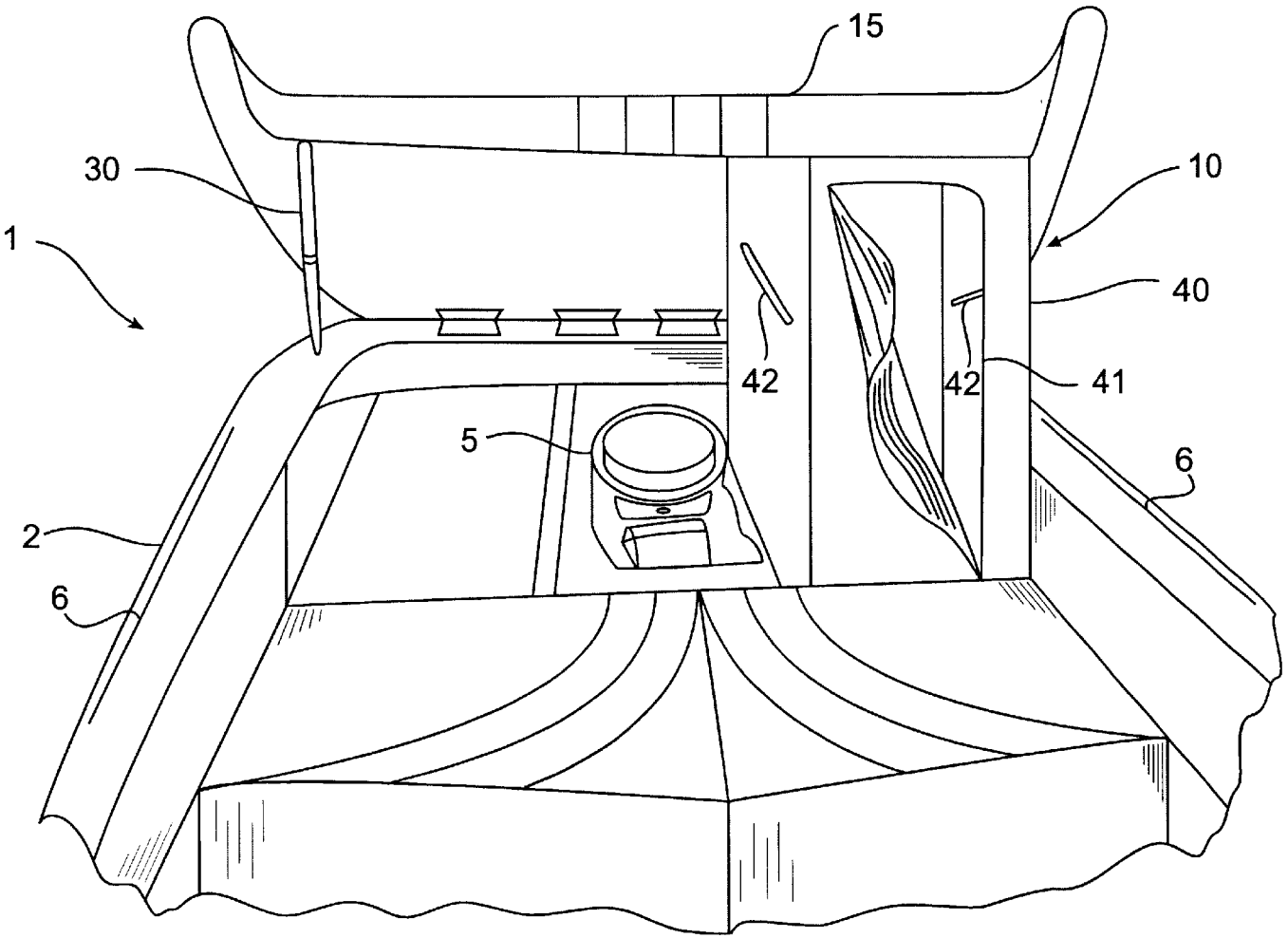
FIG. 2 is a partial perspective view of the rear of the watercraft of the present invention with the privacy compartment in the fully deployed position.

In the watercraft 1, the hull 2 includes a bow 3 and a stern 4. As shown in FIG. 2, an engine 5 is disposed at the stern 4 of the watercraft 1. The engine 5 is connected to a propulsion unit (not shown) and provides the motive force for the watercraft 1. Preferably, the engine 5 is either a two or four stroke internal combustion engine. However, other engine types may be used without deviating from the scope of the present invention. In addition, the propulsion unit preferably is a jet pump arranged at the stern 4 of the watercraft 1. As would be appreciated by those skilled in the art, however, alternative propulsion units, such as a propeller, may be substituted therefor without deviating from the scope of the present invention.

A deck 6 is disposed on the powered hull 2 and comprises the upper exterior portion of the watercraft 1. Components such as the sides and floor of the passenger area, seat sections, and other structures may be incorporated into the deck 6. For sport boats of the type contemplated for the present invention, the hull 2 and the deck 6 are separate portions forming the body of the watercraft 1. As is known to those skilled in the art, the hull 2 and the deck 6 are molded as separate sections of the watercraft 1 and are assembled together during manufacture. Once assembled (or during assembly), elements such as the captain's chair, console, windshield, etc. are added to the deck 6.

In one embodiment of the present invention, a privacy compartment 10 is located at a predetermined position relative to the engine 5. According to this embodiment, the privacy compartment 10 is preferably located within about a few feet of the engine 5. More preferably, the privacy compartment 10 is located next to (i.e., beside, in front of, behind, above, etc.) the engine 5. Most preferably, the privacy compartment 10 is located next to the engine 5 in a lateral direction relative to the longitudinal axis of the watercraft 1, as shown in FIGS. 1 and 2.

Figure 3:
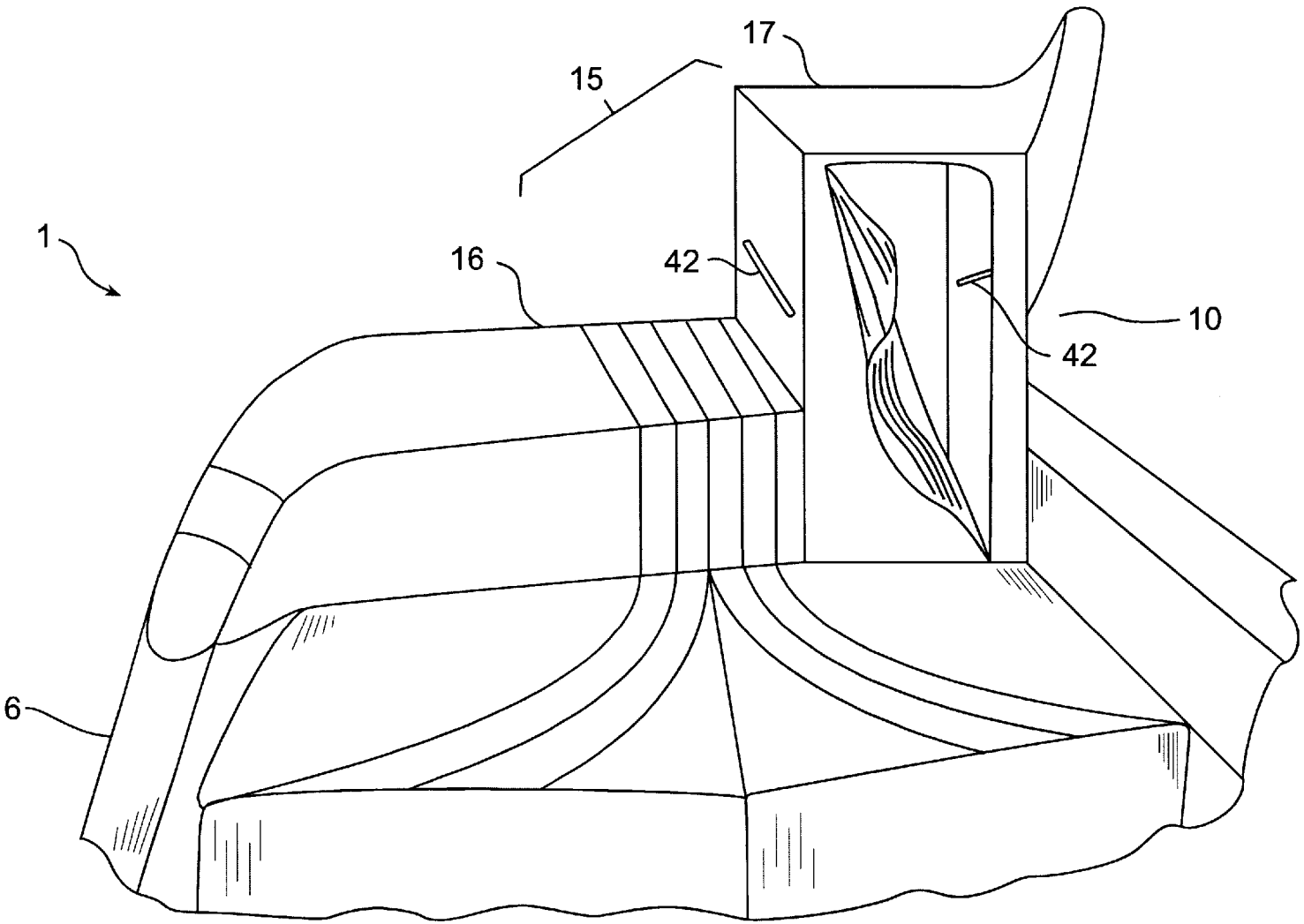
FIG. 3 is a partial perspective view of the rear of the watercraft of the present invention with an alternative engine cover.

In this embodiment, an engine cover 15 is used to cover the engine 5 and the privacy compartment 10. The engine cover 15 forms the rearward end of the deck 6. The engine cover 15 may be a single piece that is sized such that it covers both the engine 5 and the privacy compartment 10, as shown in FIG. 2. Alternatively, the engine cover 15 may comprise more than one piece, wherein one piece 16 covers the engine 5 and another, independently movable piece 17 covers the privacy compartment 10, as shown in FIG. 3. If a multiple piece engine cover 15 is used, it is preferable that adjacent surfaces of the individual pieces 16, 17 be generally flush with each other to create a streamlined appearance when both pieces 16, 17 are in their closed positions.

The engine cover 15 may be attached to the hull 2 of the watercraft 1 in any manner known to one of ordinary skill in the art. In one example, the engine cover 15 may be hingedly attached to the hull 2 along its rearward edge. Also, the sides of the engine cover 15 may be attached to the hull 2 by means of hydraulic shocks 30, which are similar to those used on an automobile's hood. The shocks 30 provide support for the engine cover 15 when opened, as shown in FIG. 2. Alternatively, the engine cover 15 may be held open by a prop rod (not shown) or other similar device. In this embodiment, the engine cover 15 is a rigid member that is connected to the hull 2 and adapted for concealing the privacy compartment 10 in the closed position and supporting the deployment of the privacy compartment 10 in the open position.

Figure 4:
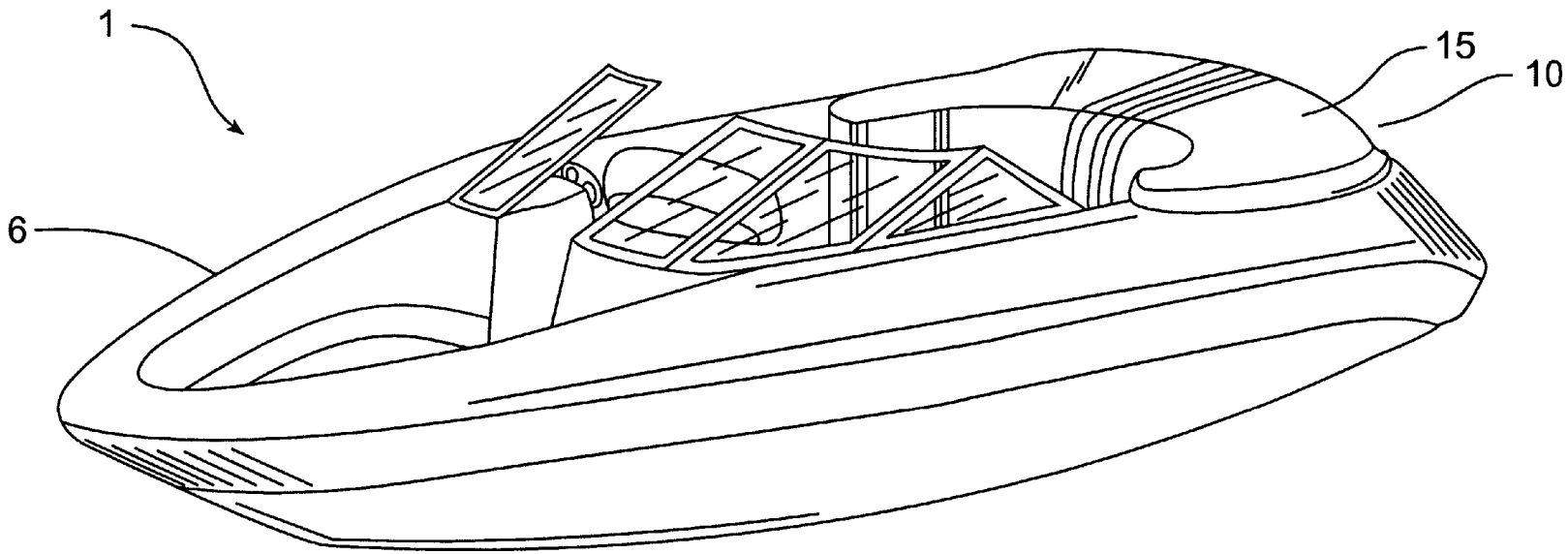
FIG. 4 is a port side perspective view of the watercraft of the present invention with the privacy compartment in the fully retracted position.

In its closed, compressed or retracted position, as shown in FIG. 4, the privacy compartment 10 is not useable. Instead, the privacy compartment 10 is at least partially concealed by the engine cover 15, and preferably, is fully concealed by the engine cover 15. In this closed position, the outside edges of the engine cover 15 are preferably generally flush with the adjacent mating surface of the deck 6.

In this embodiment, the engine cover 15 is partially L-shaped when viewed from the side. When the privacy compartment 15 is in the closed position, a first edge of the "L" forms a top side of the engine cover 15 while the second edge of the "L" forms a back rest for a seat that is incorporated into the deck 6. As a result, the engine cover 15 blends into the rest of the deck 6 to appealingly conceal the closed privacy compartment 10.

To further conceal the closed privacy compartment 10, it is preferred that at least a portion of the exterior surface of the engine cover 15 and a portion of the exterior surface of the deck 6 have the same surface finish. For example, both exterior surfaces could include gel-coated fiberglass sections. Alternatively or additionally, both surfaces could have a cloth, vinyl, or fabric cover (e.g., some variety of upholstery) with matching color schemes. Consequently, the engine cover 15 blends into the general decor of the remaining deck 6. In addition, it is preferred that the engine cover 15 mate with at least a portion of the deck 6 to complement the boat's appearance when closed.

The privacy compartment 10 may be opened by lifting the engine cover 15 until it is upright. When the privacy compartment 10 is in the open position, the second edge of the engine cover 15 functions as the top of the privacy compartment 10 while the first edge of the engine cover 15 functions as a supporting side for the open privacy compartment 10.

The hydraulic shocks 30 may be designed such that when they are extended a certain distance, they allow the privacy compartment 10 to self-deploy. That is, once the engine cover 15 is lifted a certain distance, the engine cover 15 will continue to open even without further human intervention.

While the engine cover 15 can be opened manually, it is also possible that the engine cover 15 could be motorized so that it can be opened by a mechanical and/or electrical switch (not shown). The exemplary engine cover 15 makes the compartment easily deployable.

The privacy compartment 10 could be, for example, a toilet, shower, or changing area. When opened, the interior area of the privacy compartment 10 is tall enough that a person of average height can stand-up. Preferably, the privacy compartment 10, when fully deployed, has an interior height of at least about 5 feet, 8 inches so that the privacy compartment 10 is not overly restrictive to the occupant. In other embodiments, it is contemplated that the interior height may be greater than 5 feet, 8 inches. For example, the interior height may reach 6 feet, 2 inches or more. Of course, the interior height need not be so great to accommodate a standing adult. All that is required is enough height for an adult to sit comfortably therein, especially in cases where the privacy compartment 10 encloses a toilet.

In this embodiment, the bottom of the privacy compartment 10 is integrally formed with the deck 6 and/or the hull 2. Alternatively, the bottom of the privacy compartment 10 may be a separate piece (not shown) that is placed on top of the hull 2 in such a way that it may be anchored to the hull 2.

In the embodiment shown, the privacy compartment 10 also includes a flexible curtain 40. The flexible curtain 40 is a tent-like structure that, once deployed, permits entry into the privacy compartment 10. One end of the flexible curtain 40 is secured to the bottom of the privacy compartment 10 in any suitable way known to one skilled in the art. This includes, but is not limited to, the use of snaps, rivets, and the like.

The other end of the flexible curtain 40 is connected to the engine cover 15 in any suitable way known to one skilled in the art. Preferably, the flexible curtain 40 is connected to the engine cover 15 in such a way that it can be detached without substantial effort.

In this embodiment, the privacy compartment 10, once deployed, can be accessed through an opening in the flexible curtain 40. The opening can then be closed by means of a zipper, snaps, or any other suitable closure means. Preferably, the opening is closed by means of a zipper 41, as illustrated in FIG. 2. When the opening is closed, the cover 15 and curtain 40 combine to fully enclose the privacy compartment 10. In this embodiment, the flexible curtain 40 is constructed of fabric. An acceptable fabric could be, for example, a canvas-type material.

FIG. 2 also shows the position of battens 42, which are preferably rigid cylindrical rods that are sewn into the flexible curtain 40. The battens 42 help give the flexible curtain 40 form once the privacy compartment 10 is deployed. Also, the battens 42 help prevent billowing of the flexible curtain 40 when the privacy compartment 10 is collapsed. The battens 42 permit the canvas fabric to fold easily without becoming caught between the engine cover 15 and the deck 6, while the engine cover 15 is being closed.

In addition, a mesh fabric is preferably provided at the rear of the privacy compartment 10. The mesh fabric permits air to escape from the flexible curtain 40 when the privacy compartment 10 is collapsed. The mesh fabric also provides ventilation for the privacy compartment 10 while the privacy compartment 10 is deployed.

Figure 5:
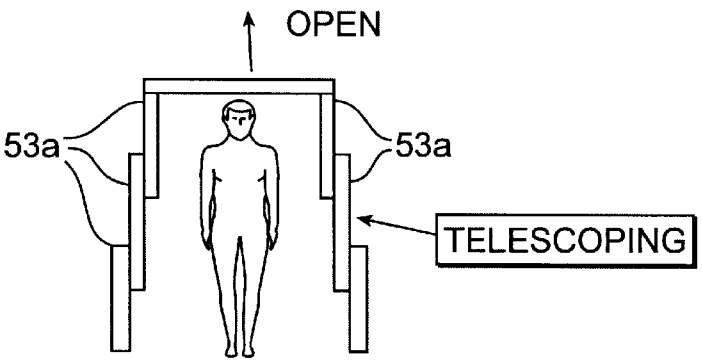
FIG. 5 is a view of a first alternative scheme for the privacy compartment.

In another embodiment of the present invention, illustrated in FIG. 5, the sides 53*a* of the cover 53 of the privacy compartment 10 telescope upwardly from the deck 6 to create the compartment 10 as illustrated. When the privacy compartment 10 is in the closed position, the sides 53*a* are preferably at least partially concealed by the cover 53. When the privacy compartment 10 is in the open position, the cover 53 forms the top of the privacy compartment 10 and is structurally supported by the telescoping sides 53*a*. A curtain having a zippered door could be attached to the cover 53 and side supports 53*a* to provide a front wall and entrance to the privacy compartment 10.

Figure 6:
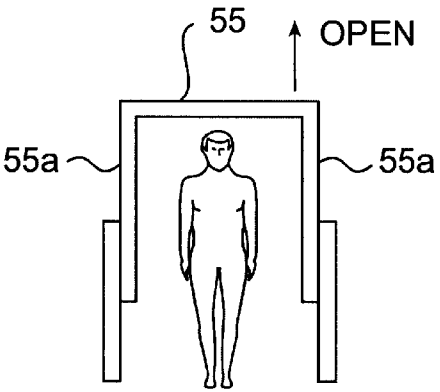
FIG. 6 is a view of a second alternative scheme for the privacy compartment.

In yet another embodiment, illustrated in FIG. 6, the cover 55 could be provided with a singular constructed portion like a bucket that extends upwardly from the deck 6 to deploy the privacy compartment into the open position. When the privacy compartment is in the closed position, the sides 55*a* of the cover 55 are at least partially concealed by the cover 55. When the privacy compartment is extended into the open position, the sides 55*a* form the side of the privacy compartment 10 and support the top of the cover 55. A curtain having a zippered door could be attached to the cover 55 to provide a front wall and entrance to the privacy compartment 10.

Figure 7:
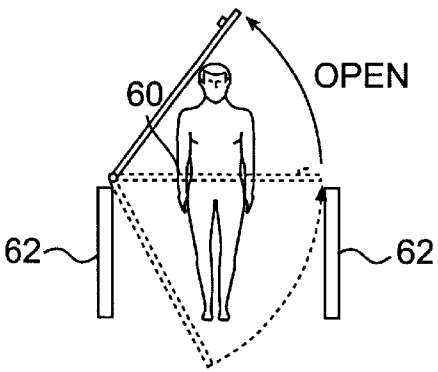
FIG. 7 is a view of a third alternative scheme for the privacy compartment.

In a third possible embodiment, the cover 60 of the privacy compartment 10 could include a curved (or triangular) front wall that is pivotally articulated at a left or right side of the privacy compartment 10 to form the privacy area, as shown in FIG. 7. When the privacy compartment 10 is in the closed position, the cover 60 may lay flat across the top of the side supports 62 or may extend downwardly into the space between the side supports 62. At least a portion of the privacy compartment 10 is thereby concealed underneath the closed cover 60. To deploy the privacy compartment 10 into its open position, a user pivots the top 60 upwardly in the direction of the arrow until the top 60 is angled upwardly above the side supports 62. As with the previous embodiments, hydraulic shocks or a prop rod (not shown) could be used to keep the privacy compartment 10 open. A curtain having a zippered door could be attached to the cover 60 and side supports 62 to provide a front wall and entrance.

Figure 8:
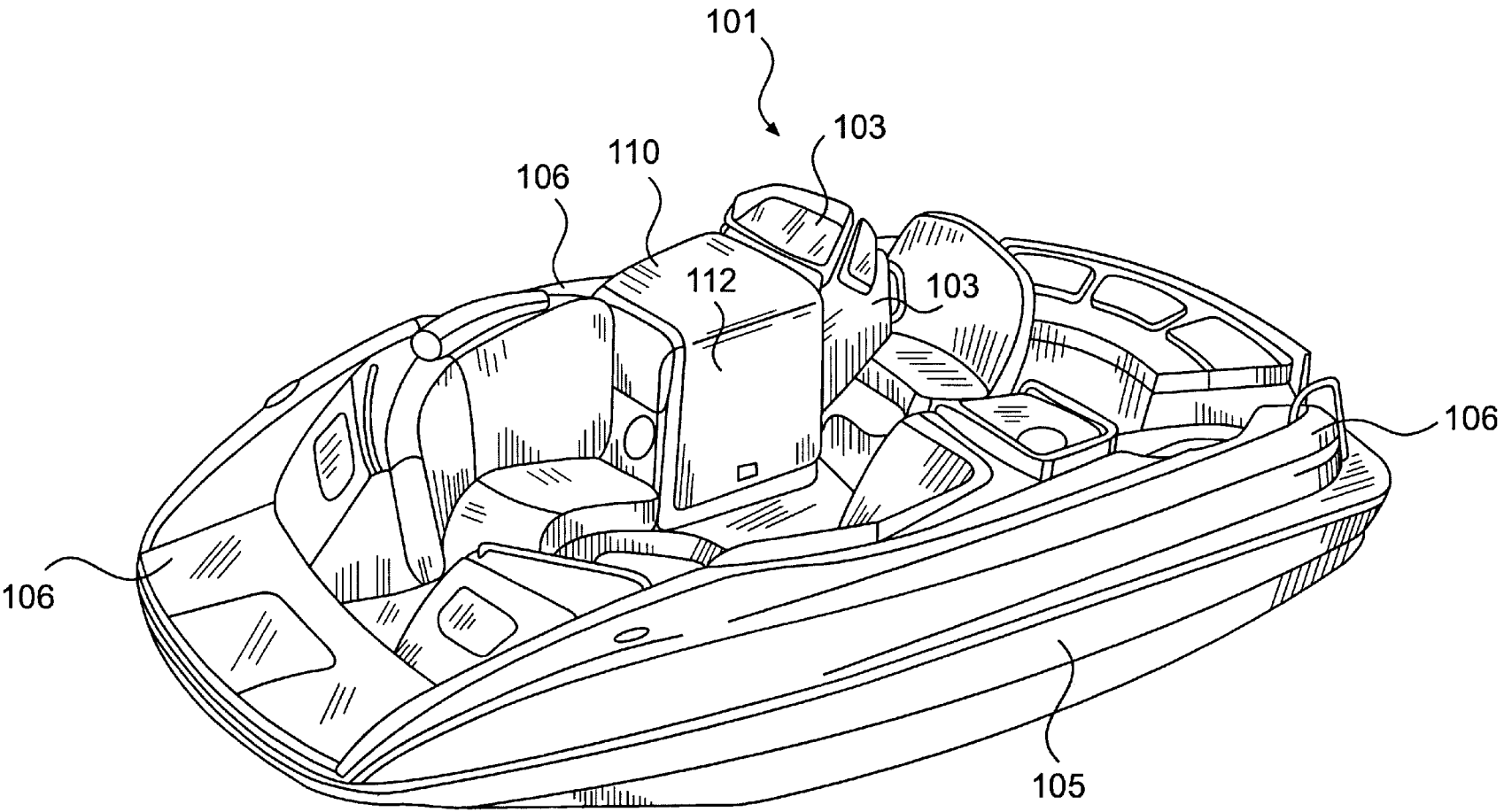
FIG. 8 is a perspective view of additional alternative embodiment of watercraft of the present invention.
Figure 9:
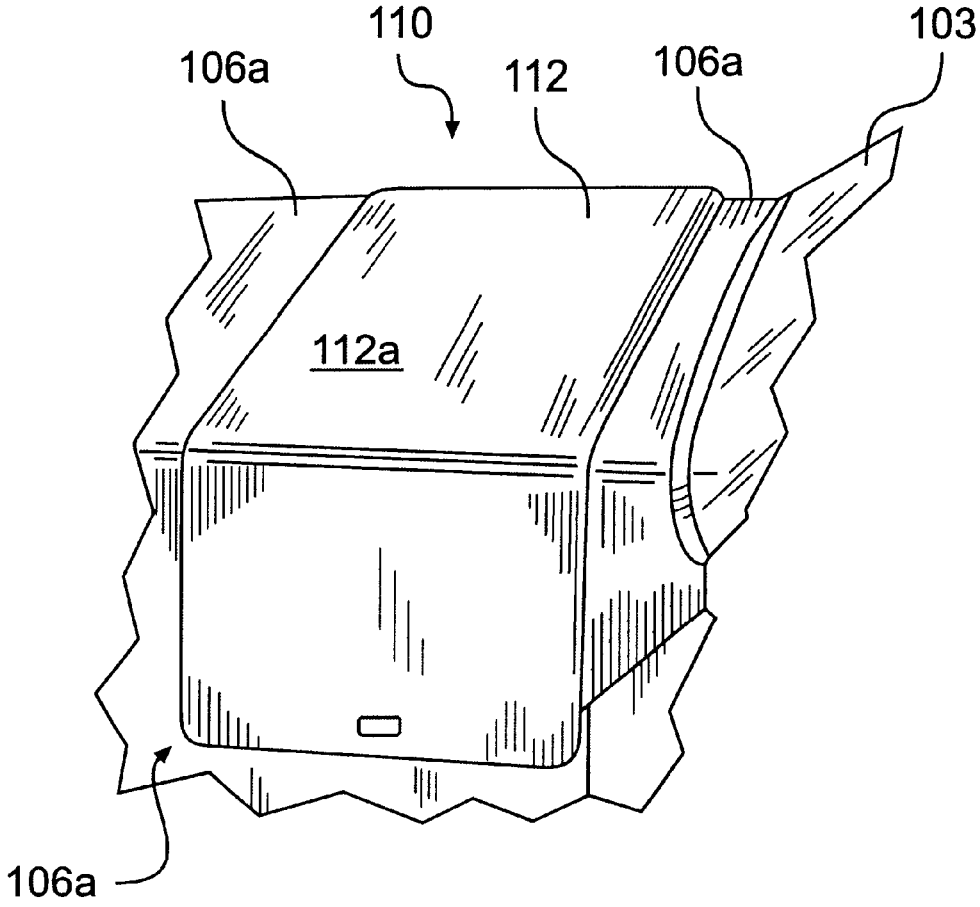
FIG. 9 is a partial perspective view of the closed privacy compartment of the additional alternative embodiment.
Figure 10:
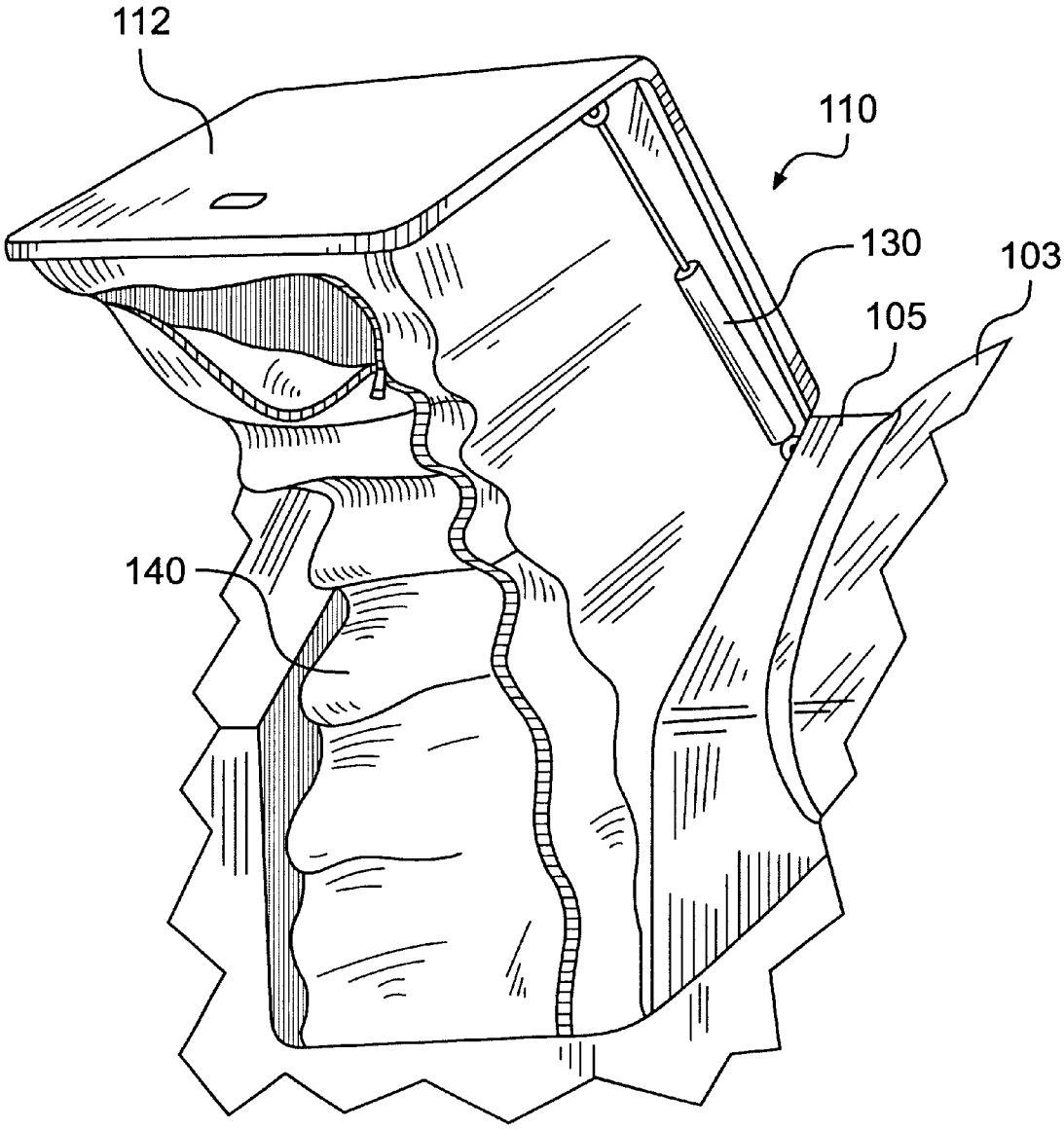
FIG. 10 is a partial perspective view of the partially opened privacy compartment of the additional alternative embodiment.

FIGS. 8–10 illustrate an additional alternative embodiment in which the privacy compartment is disposed forward of a steering console rather than near the rear end of a watercraft as in the previously described embodiments.

As illustrated in FIG. 8, the watercraft 101 is a deck boat. A deck 106 is disposed on a powered hull 105. In this embodiment, a variety of walkways, walls, seats, and other equipment are disposed in and on the deck 106. A steering console 103 for controlling the watercraft 101 is centrally disposed on the deck 106. A privacy compartment 110 is disposed forward of the steering console 103 along a starboard side of the watercraft 101.

A cover 112 of the privacy compartment is hingedly attached to an upper side portion of the deck 106. While the cover 112 in this embodiment is hingedly attached to the deck 106, any other mechanism such as those shown in FIGS. 5–7 could also be used to connect the cover 112 to the watercraft 101.

FIG. 9 shows the privacy compartment 110 in its closed position. In the closed position, the cover 112 blends into the decor of the watercraft 101 such that an exterior surface

112*a* of the cover 112 is generally flush with an adjacent exterior surface 106*a* of the deck 106. At a minimum the cover 112 at least partially mates with the deck 106 to complement the overall appearance of the watercraft 101. In the closed position, the privacy compartment 110 is not useable, but a driver, who is positioned behind the privacy compartment 110 at the steering console 103, can see easily over the privacy compartment 110. The cover 112 is L-shaped to match the corresponding surface shape of the adjacent surface 106*a* of the deck 106 when the privacy compartment 110 is in the closed position. As with the previous embodiments, at least a portion of the exterior surfaces 106*a*, 112*a* of the deck 106 and cover 112 are preferably finished in the same manner (i.e. gel-coated fiberglass, matching fabric covering or color scheme, etc.) such that the closed privacy compartment 110 blends in with the decor of the deck 106.

FIG. 10 illustrates the privacy compartment 110 in a partially opened position. The L-shape of the cover 112 enables the cover 112 to function as both a back side and a rigid top of the opened privacy compartment 110. As in the previous embodiments, the privacy compartment 110 preferably includes hydraulic shocks 130 that facilitate the opening and closing of the cover 112 and a flexible curtain 140 that is connected to the cover 112 to form the sides of the privacy compartment 110. Other features of the previous embodiments (such as battens, motorized deployment means, zippered doors, etc.) may also be incorporated into this embodiment without departing from the scope of the present invention.

Although the privacy compartments 10, 110 illustrated herein are shown to be disposed either in the rear of the watercraft 1 (as illustrated in the previous embodiments) or in the side of the watercraft 101 (as illustrated in this embodiment), a privacy compartment according to the present invention may be disposed in a variety of other positions on the watercraft. An appropriate position for the privacy department depends on the specific watercraft and accompanying design requirements, as would be understood by one skilled in the art. For example, the privacy compartment could be disposed in the deck at the bow of a watercraft. The privacy compartment could also be disposed in a central portion of the deck that is spaced away from the sides, bow, and stem of the watercraft.

From the invention thus described, it will be obvious to those skilled in the art that the invention may be varied in many ways. For example, components illustrated in separate embodiments can be combined where appropriate. Such variations are not to be regarded as a departure from the spirit and scope of the invention, and all such modifications as would be obvious to one skilled in the art are intended for inclusion within the scope of the following claims.

What is claimed is:

1. A watercraft comprising:

a hull;

a deck disposed on the hull;

a collapsible privacy compartment disposed in the deck, the collapsible privacy compartment having a closed position and an open position that accommodates an adult therein; and a cover adapted to (1) mate with at least a portion of the deck when in the closed position, (2) conceal at least a portion of the privacy compartment when in the closed position, and (3) provide at least partial support for the privacy compartment when deployed in the open position, wherein the cover covers both an engine of the watercraft and the privacy compartment when the privacy compartment is in the closed position.

2. A watercraft according to claim 1, wherein the watercraft further comprises a flexible curtain connected to the cover and adapted to provide (i) entry into the privacy compartment when the privacy compartment is in the open position and (ii) privacy when the flexible curtain is closed and the privacy compartment is in the open position.

3. A watercraft according to claim 1, wherein the privacy compartment in the open position is adapted to provide privacy for an average-sized adult.

4. A watercraft according to claim 3, wherein at least a portion the privacy compartment in the open position has an internal height of at least 68 inches.

5. A watercraft according to claim 4, wherein at least a portion the privacy compartment in the open position has an internal height of at least 74 inches.

6. A watercraft according to claim 1, wherein the cover includes a number of overlapping sides configured to telescope from the closed position to the open position.

7. A watercraft according to claim 6, wherein the cover is substantially shaped according to at least one of an L-shape and a triangular-shape.

8. A watercraft according to claim 6, wherein the cover supports a top side of the privacy compartment when the privacy compartment is in the open position.

9. A watercraft according to claim 1, wherein the cover is pivotally connected to the deck such that the cover can be rotated upwardly to deploy the privacy compartment into the open position.

10. A watercraft according to claim 1, wherein an outer surface of the cover is generally flush with an outer surface of the deck when the privacy compartment is in the closed position.

11. A watercraft according to claim 1, wherein the privacy compartment includes at least one of a toilet area, a changing area, and a shower.

12. A watercraft comprising:

a hull;

a deck disposed on the hull;

a collapsible privacy compartment disposed in the deck, the collapsible privacy compartment having a closed position and an open position that accommodates an adult therein; and an engine cover having first and second independently movable pieces, the first piece being adapted to selectively cover an engine of the watercraft and the second piece comprising a cover adapted to (1) mate with at least a portion of the deck when in the closed position, (2) conceal at least a portion of the privacy compartment when in the closed position, and (3) provide at least partial support for the privacy compartment when deployed in the open position, wherein when both pieces are closed, exterior surfaces of the first and second pieces are adjacent to and generally flush with each other.

13. A watercraft according to claim 12, wherein the watercraft further comprises a flexible curtain connected to the cover and adapted to provide (i) entry into the privacy compartment when the privacy compartment is in the open position and (ii) privacy when the flexible curtain is closed and the privacy compartment is in the open position.

14. A watercraft according to claim 12, wherein the privacy compartment in the open position is adapted to provide privacy for an average-sized adult.

15. A watercraft according to claim 14, wherein at least a portion the privacy compartment in the open position has an internal height of at least 68 inches.

16. A watercraft according to claim 15, wherein at least a portion the privacy compartment in the open position has an internal height of at least 74 inches.

17. A watercraft according to claim 12, wherein the cover includes a number of overlapping sides configured to telescope from the closed position to the open position.

18. A watercraft according to claim 17, wherein the cover is substantially shaped according to at least one of an L-shape and a triangular-shape.

19. A watercraft according to claim 17, wherein the cover supports a top side of the privacy compartment when the privacy compartment is in the open position.

20. A watercraft according to claim 12, wherein the cover is pivotally connected to the deck such that the cover can be rotated upwardly to deploy the privacy compartment into the open position.

21. A watercraft according to claim 12, wherein an outer surface of the cover is generally flush with an outer surface of the deck when the privacy compartment is in the closed position.

22. A watercraft according to claim 12, wherein the privacy compartment includes at least one of a toilet area, a changing area, and a shower.

* * * * *